US005894192A

United States Patent [19]

Grabis

[11] Patent Number: 5,894,192

[45] Date of Patent: Apr. 13, 1999

[54] NON-MESH CONFORMING FILTER FOR A VIDEO DISPLAY UNIT

[75] Inventor: Dietrich W. Grabis, 58 Oakdale Ave., San Rafael, Calif. 94901

[73] Assignee: Dietrich W. Grabis, San Rafael, Calif.

[21] Appl. No.: 08/263,015

[22] Filed: Jun. 20, 1994

Related U.S. Application Data

[63] Continuation of application No. 08/047,165, Apr. 14, 1993, abandoned, which is a continuation of application No. 07/729,949, Jul. 15, 1991, abandoned.

[51] Int. Cl.[6] ..... H01J 29/01

[52] U.S. Cl. ..... 313/478

[58] Field of Search ..... 313/478, 479; 348/835, 834, 832; 445/22, 23, 24

[56] References Cited

U.S. PATENT DOCUMENTS

| | | | |
|---|---|---|---|
| 3,582,189 | 6/1971 | Moritz et al. | 358/252 X |
| 4,468,702 | 8/1984 | Jandrell | 358/245 |
| 4,686,576 | 8/1987 | Dickie et al. | 358/253 X |
| 4,732,454 | 3/1988 | Saito et al. | 350/164 |
| 4,788,597 | 11/1988 | Gart et al. | 358/252 X |
| 4,910,090 | 3/1990 | Kuhlman et al. | 358/252 X |

FOREIGN PATENT DOCUMENTS

| | | | |
|---|---|---|---|
| 0113218 | 7/1984 | European Pat. Off. . | |
| 2712321 | 9/1978 | Germany . | |
| 281443 | 12/1986 | Japan | 313/478 |
| 8904099 | 5/1989 | WIPO . | |

OTHER PUBLICATIONS

*IBM Technical Disclosure Bulletin* vol. 32, No. 5B, Oct., 1989, New York US, pp. 481–482.

*Machine Design* vol. 57, No. 6, Mar., 1985, Cleveland, Ohio, US, p. 70.

*Primary Examiner*—Sandra O'Shea

*Attorney, Agent, or Firm*—Jerry G. Wright; Flehr Hohbach Test Albritton and Herbert LLC

[57] ABSTRACT

A conforming filter for a video display unit (VDU). The VDU includes a cathode ray tube (CRT) with a curved faceplate and an aperture defining bezel. The filter includes a plastic substrate having a thickness between about 0.8 and 1.2 mm. The thickness is such that the filter may be made to substantially conform to the curvature of a cathode ray tube faceplate. The filter may be assembled in a VDU by removing the bezel, locating the filter adjacent the CRT, and applying pressure around a perimeter region of the filter to cause it to substantially conform to the curvature of the faceplate. The filter may be retained in a conforming position adjacent the faceplate by the bezel. The filter may also be attached to a bezel having a curved surface. The filter conforms to the curvature of the surface when then attached.

5 Claims, 5 Drawing Sheets

NON-MESH CONFORMING FILTER FOR A VIDEO DISPLAY UNIT

This is a continuation of Ser. No. 08/047,165, filed on Apr. 14, 1993 now abandoned which is a continuation of application Ser. No. 07/729,949, filed Jul. 15, 1991 now abandoned.

BACKGROUND OF THE INVENTION

The present invention is directed in general to protective anti-glare and electromagnetic radiation suppressing filters for video display units (VDU's). The present invention is directed in particular to a filter which will conform to the curvature of the faceplate of a cathode ray tube (CRT). A protective filter for a VDU preferably has at least anti-reflective properties. The anti-reflective properties may protect a VDU user's eyes from strain by suppressing reflected glare and the reflected images of extraneous objects. Further, it may be desirable for the filter to have an electrically conductive surface. The electrically conductive surface may thus conduct to ground static charges and electromagnetic fields generated by the high voltage cathode ray tube of the VDU.

Filters may be designed to attenuate visible light by between about 35 and 80 percent. Light which is reflected from the screen or faceplate of the CRT must pass through the filter twice, while light from an image on the screen passes through the filter only once. In a 65 percent attenuating filter, for example, screen reflection will be attenuated by about a factor of ten while light from an image on the screen will be attenuated by a factor of only three. Thus the light attenuating filter enhances image contrast.

VDU's are not usually fitted with filters by VDU manufacturers. A filter is usually retrofitted to a VDU. The filters should thus be easily fitted to the VDU without the need for special skills or special tools. A filter should preferably be as close as possible to the faceplate of a VDU. This may reduce the distracting effects of double reflected images, however dim, from the faceplate and the filter surfaces. Proximity of a conductive filter to the faceplate may also be important in reducing leakage of electromagnetic fields around the filter, that is, through a gap between the filter and the faceplate. Preferably, therefore a filter should conform as closely as possible to the curvature of the faceplate.

A conforming filter may be made by using as a substrate for filter coatings a preformed rigid panel of glass or plastic. Filter coatings may be deposited on either a first surface of the substrate, the second surface, or both. A filter coating may be designed to have anti-reflective properties, to attenuate light, or to be electrically conductive. A filter coating may also be designed to be both anti-reflective and electrically conductive. A flat filter on a plastic substrate is described in U.S. Pat. No. 4,732,454. The disclosure describes how the different filter coatings may be applied. A preformed conforming filter may have similar filter coatings, however the filter coatings on curved substrates may be more difficult to produce economically. Further, every different size and shape of a VDU faceplate would require a specific pored substrate, further adding to manufacturing costs and inventory costs.

A filter coating may be coated on thin plastic web or foil material. Such a coating is usually applied in a so-called roll coater. In a roll coater, the web is wound from a supply roll over film depositing sources onto a take up roll. Thus, coatings may be deposited at relatively low cost. Generally, however, it is only practical to thus coat one surface of the web. This may reduce the range of filter properties that may be achieved. Further, thin plastic web filters may be very difficult to apply to a CRT faceplate without adhesives, and without wrinkling of the filter. Thus such a filter may not be suitable for retrofitting to a VDU.

Another approach to constructing a conforming filter for a VDU is to construct the filter from a conductive mesh. The mesh may be held suspended in a frame. The mesh filter can be made to conform to the surface curvature of a curved faceplate by applying pressure to the frame when the filter is held adjacent to the faceplate. The filter may be retained in a conforming position by adhesive material between the frame and the faceplate. The filter may also be held in a conforming position by an aperture defining bezel located around the perimeter of the faceplate, U.S. Pat. No 4,468,702 discloses such a mesh filter.

A mesh filter may be constructed from a metal mesh or a conductively coated mesh of a yarn material. Thus a mesh filter may effectively suppress electromagnetic radiation. A mesh filter may also fulfill optical functions. For example, the mesh may be given a matt coloration, preferably black, to help suppress reflection and glare. A mesh filter may also attenuate light by obscuration produced by the strands of the mesh. The optical functions of a mesh filter may not be as effective or have the same degree of versatility as the optical functions possible using filter coatings deposited on one or both surfaces of a transparent substrate.

SUMMARY OF THE INVENTION

It is an object of the present invention to provide a conforming filter for a VDU without the use of conductive mesh.

It is another object of the present invention to provide a conforming filter for a VDU on a substrate which is rigid enough to be coated as a flat sheet but sufficiently flexible that it may be made to conform to the curvature of a curved faceplate by applying pressure to a perimeter region of the filter when the filter is held against the faceplate.

It is a further object of the invention to produce a conforming filter which may be easily fitted to a VDU without the need for special tools or special skills.

In one preferred embodiment, the present invention comprises a transparent plastic substrate. The substrate is coated on at least one surface with a filter coating having at least anti-reflective properties. The filter coating may also include at least one electrically conductive layer and may also attenuate visible light. A filter coating may also be deposited on another surface of the substrate.

The substrate is preferably rigid enough to have filter coatings applied when it is in the form of a flat sheet, yet flexible enough that the filter may be caused to substantially conform to the curvature of a CRT faceplate by placing the filter against the faceplate and applying pressure around a perimeter region of the filter. The desired properties of the substrate are obtained when the thickness of the substrate is between about 0.8 and 1.2 millimeters (mm). Plastics such as acrylics, polyesters, and polycarbonates may be suitable substrate materials. Polycarbonate is the preferred substrate material. A polycarbonate substrate is preferably about 1.0 mm thick.

The filter may be retained in a conforming position by a bezel defining a viewing aperture on the CRT faceplate. The filter may also be retained in position by adhesive strips around the perimeter region of the filter. The adhesive strips may be transparent. The filter may be designed to attenuate light through the use of light attenuating filter coatings, light attenuating material incorporated in the substrate, or both. Filter coatings incorporating conductive layers may have grounding means for connecting the conductive layers to ground. The filters may be protected by removable protective sheets prior to installation in a VDU.

BRIEF DESCRIPTION OF THE DRAWINGS

The accompanying drawings, which are incorporated in and constitute a part of the specification, schematically illustrate a preferred embodiment of the present invention and together with general description given above and the detailed description of the preferred embodiment given below serve to explain the principles of the invention.

DETAILED DESCRIPTION OF THE DRAWINGS

Figure 1:
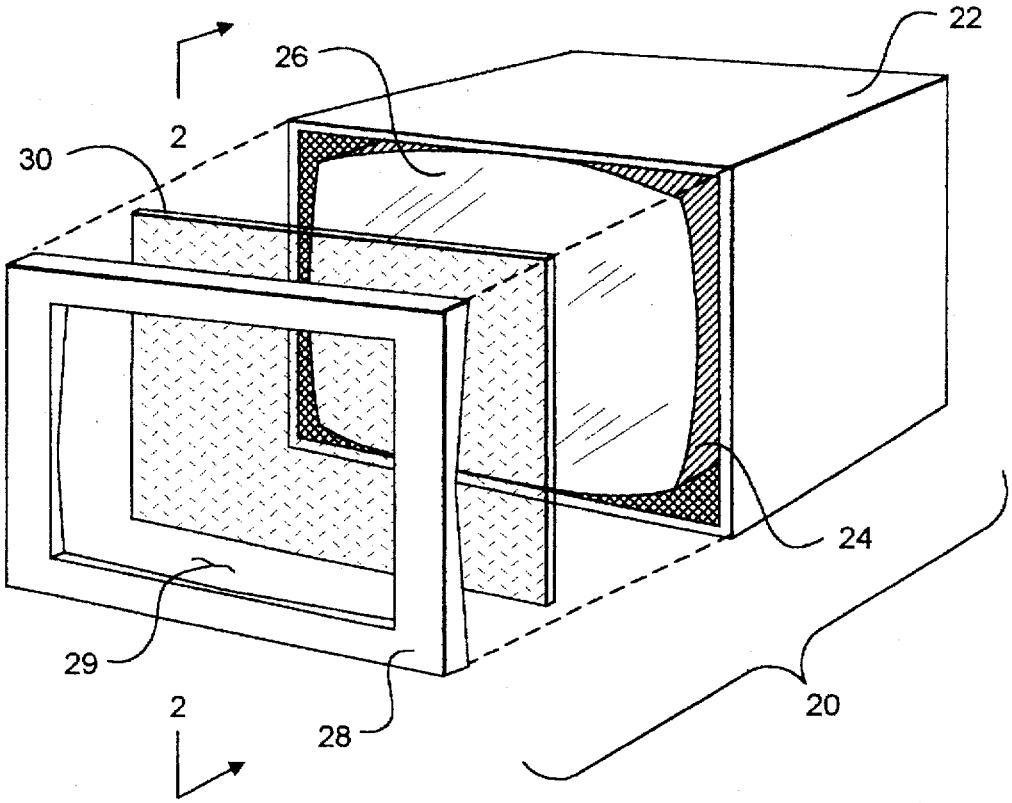
FIG. 1 schematically illustrates an exploded view of a VDU including the VDU housing, the CRT faceplate, a conforming filter according to the present invention, and a bezel.
Figure 2:
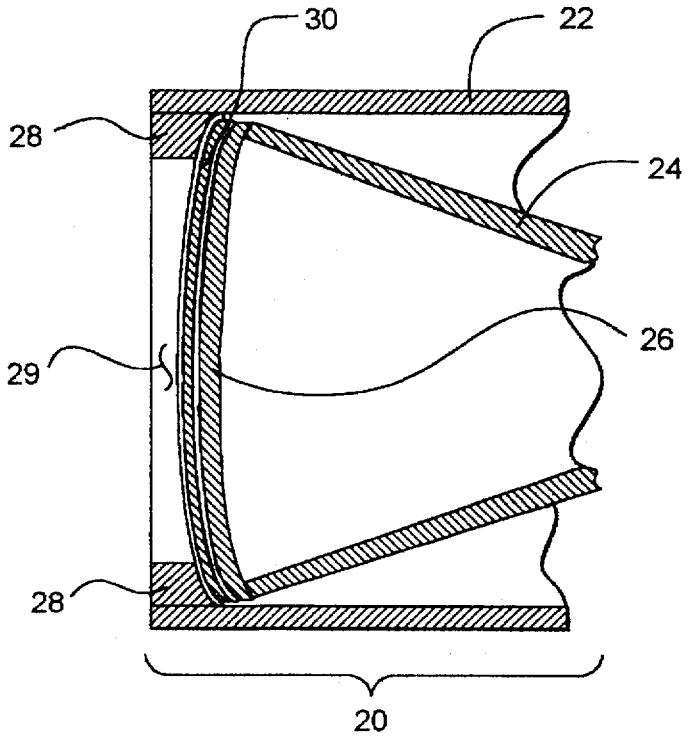
FIG. 2 schematically illustrates a longitudinal cross section through the VDU of FIG. 1, taken in the direction 2—2, showing a conforming filter according to the present invention held in a conforming position by a bezel.

Referring now to the drawings in which like components are given the same reference numerals, a preferred embodiment of the present invention is illustrated by FIGS. 1 and 2.

FIG. 1 illustrates component parts of a VDU assembly 20. The VDU assembly includes a housing 22. Inside housing 22 is located a cathode ray tube 24 including a curved faceplate 26. A bezel 28, defining a viewing aperture 29, and the conforming filter 30 of the present invention are shown separated from housing 22, that is, not assembled. Filter 30 is normally substantially flat when not assembled.

Figure 3:
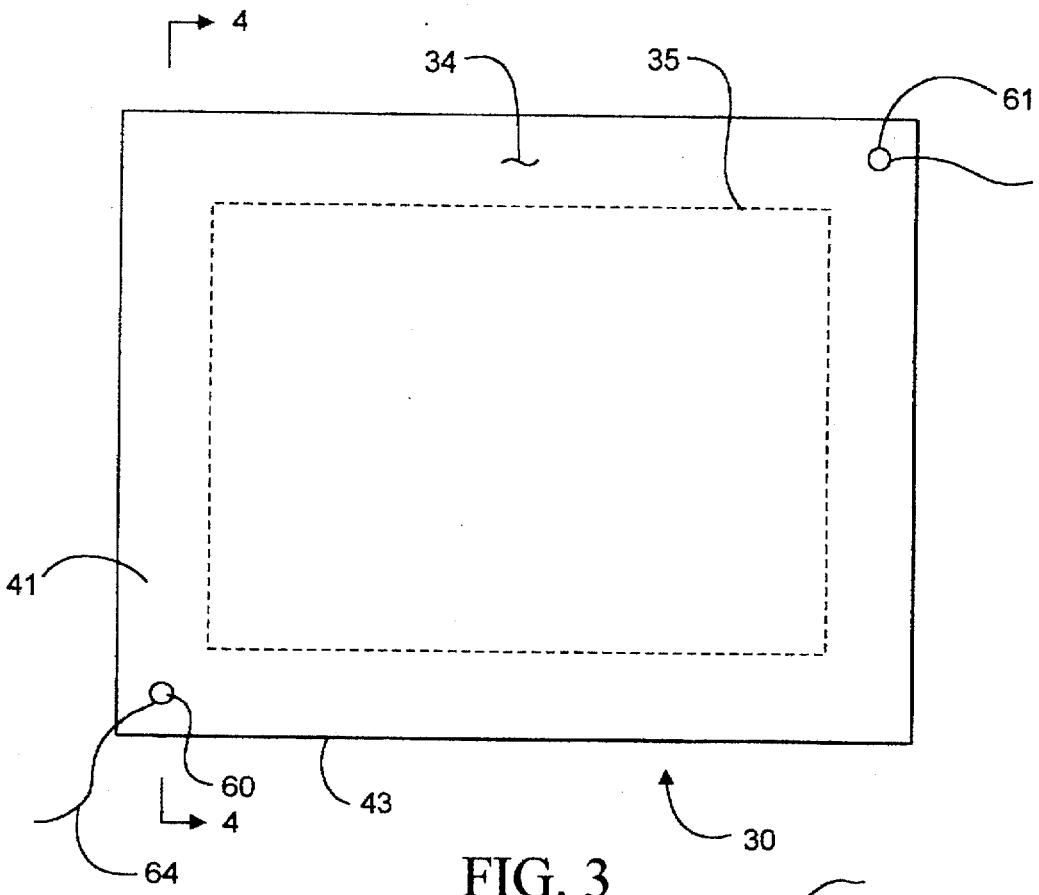
FIG. 3 schematically illustrates a plan view of a conforming filter according to the present invention.

Referring now to FIG. 2, which shows a completed assembly, conforming filter 30 is located between bezel 28 and faceplate 26. Filter 30 conforms substantially to the curvature of faceplate 26. Bezel 28 may be used as shown to retain the filter in a conforming position. FIG. 3 illustrates a plan view of a filter 30. The filter 30 is substantially rectangular and big enough that it covers aperture 29 of bezel 28 of FIG. 2. A perimeter region 34, indicated by broken line 35, may be located entirely, or in part, between bezel 28 and faceplate 26 when filter 30 is assembled in VDU assembly 20.

Filter 30 is assembled in VDU 20 by removing bezel 28, locating filter 30 in contact with faceplate 26, applying pressure to perimeter region 34 to cause filter 30 to substantially conform to the curvature of faceplate 26, and replacing bezel 28 to retain filter 30 in a conforming position. Bezel 28 may be retained in position in housing 22 by usual mounting means such as screws or clips (not shown), or may be simply held by friction and the force of a press fit.

Figure 4:
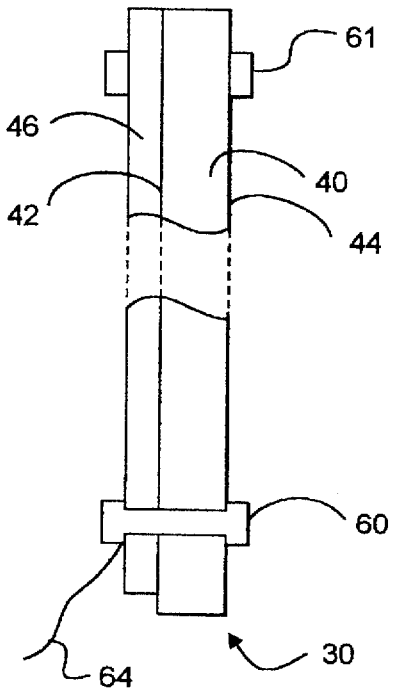
FIG. 4 schematically illustrates a cross section of the filter of FIG. 3 taken in the direction 4–4. The filter is coated on one surface.
Figure 5:
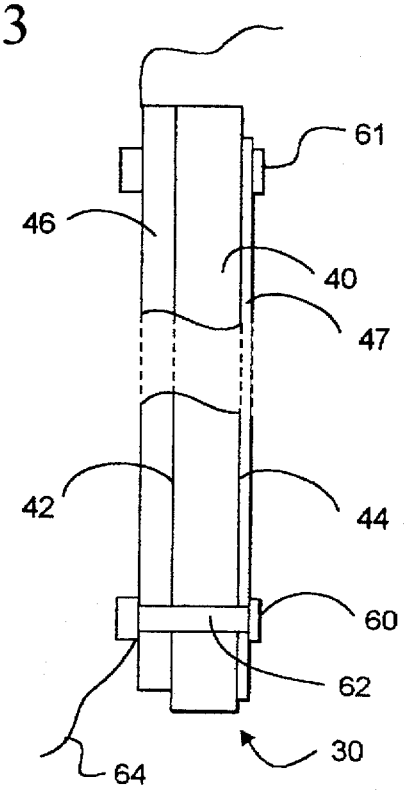
FIG. 5 schematically illustrates a cross section of the filter of FIG. 3 taken in the direction 4—4. The filter is coated on two surfaces.

Referring now to FIG. 4, filter 30 includes a transparent plastic substrate 40 having a first surface 42 and a second surface 44. First surface 42 includes a filter coating 46. Filter coating 46 is a thin film optical coating and may be deposited on substrate 40 by any of the well known optical thin film deposition methods including thermal evaporation, sputtering and chemical vapor deposition. Substrate 40 may also include a filter coating 47 on second surface 44 (FIG. 5).

Substrate 40 may be of any of the well known transparent plastic materials including acrylics, polyesters, polysulfones and polycarbonates. Polycarbonate is the preferred substrate material. Polycarbonate may be obtained commercially under the tradename "Lexan" from the General Electric Company (GE) of Pittsfield Mass. A dyed polycarbonate material which attenuates visible light may be used. Such a material may be obtained under the tradename "Lexan Grey" from GE. Dyed polycarbonate material may attenuate visible light by between about thirty five percent and eighty percent.

The thickness, A, of plastic substrate 40 is important to the operation of the present invention. In one embodiment thickness A preferably should be between about 0.8 mm and 1.2 mm in order that filter 30 substantially conform to the curvature of faceplate 26 when pressure is applied to perimeter zone 34. If thickness A is less than 0.8 mm, folds may form in substrate 40 when pressure is applied to perimeter region 34. Folds in substrate 40 may cause distortion of displayed information in the region of the folds. If thickness A is very much less than 0.8 mm, substrate 40 may not retain an original shape and may be easily damaged by less than careful handling. For example it may become permanently folded or creased. If thickness A is greater than 1.2 mm, substrate 40 may be so rigid that it can not be caused to comply with the curvature of faceplate 26 by applying pressure to perimeter region 34. The preferred thickness for polycarbonate substrate material is about 1.0 mm.

Filter coatings 46 and 47 may comprise a single layer or a plurality of layers. Filter coatings 46 and 47 preferably have at least anti-reflective properties. Filter coatings 46 and 47 may also incorporate at least one electrically conductive layer to impart electrical conductivity to the coating. Anti-reflective filter coatings may incorporate metal layers. Such metal layers may provide coatings with a relatively high sheet resistance; for example, on the order of one thousand ohms per square mm. Such coatings would be useful primarily to prevent static charge build up. Filter coatings 46 and 47 may include a layer of a semi-conducting transparent oxide material such as indium tin oxide, tin antimony oxide or cadmium tin oxide. Such layers may provide filter coatings with a relatively low sheet resistance, for example about 100 ohms per square mm or less. Such filter coatings would be advantageous in suppressing electromagnetic radiation.

Filter coatings 46 and 47 may, also attenuate visible light. Visible light attenuation in the filter coatings may be accomplished by the inclusion of metal layers, light absorbing dielectric materials or light absorbing semi-conductor materials, alone or in combination. Methods for producing the above described coatings are well known to practitioners of the art, and coating services for producing such coatings are available from commercial suppliers.

Figure 6:
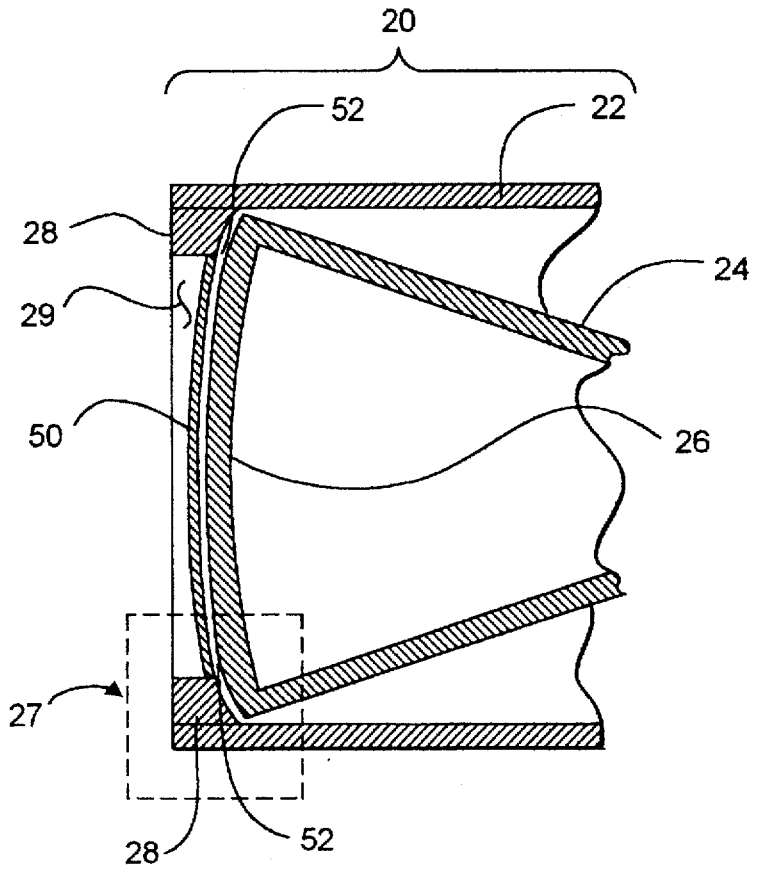
FIG. 6 schematically illustrates a cross section through a VDU showing a conforming filter according to the present invention held in a conforming position by adhesive strips around a perimeter region of the filter.
Figure 6A:
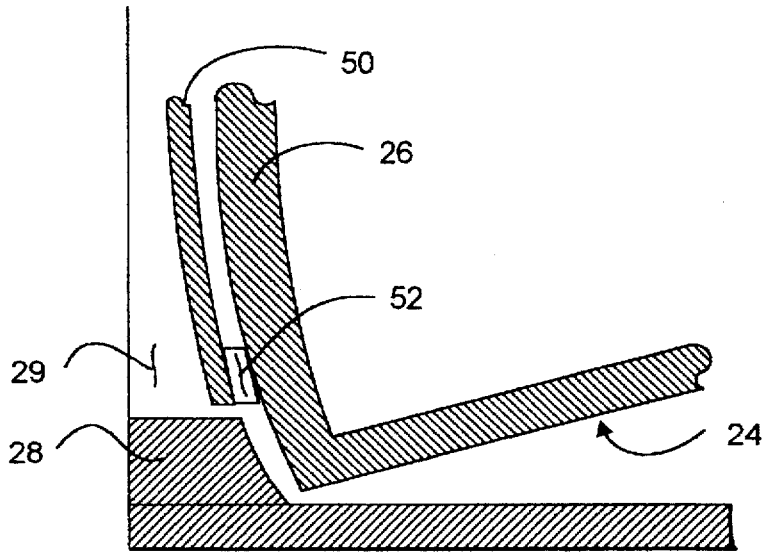
FIG. 6A schematically illustrates details of the location of the adhesive strips of FIG. 6.
Figure 7:
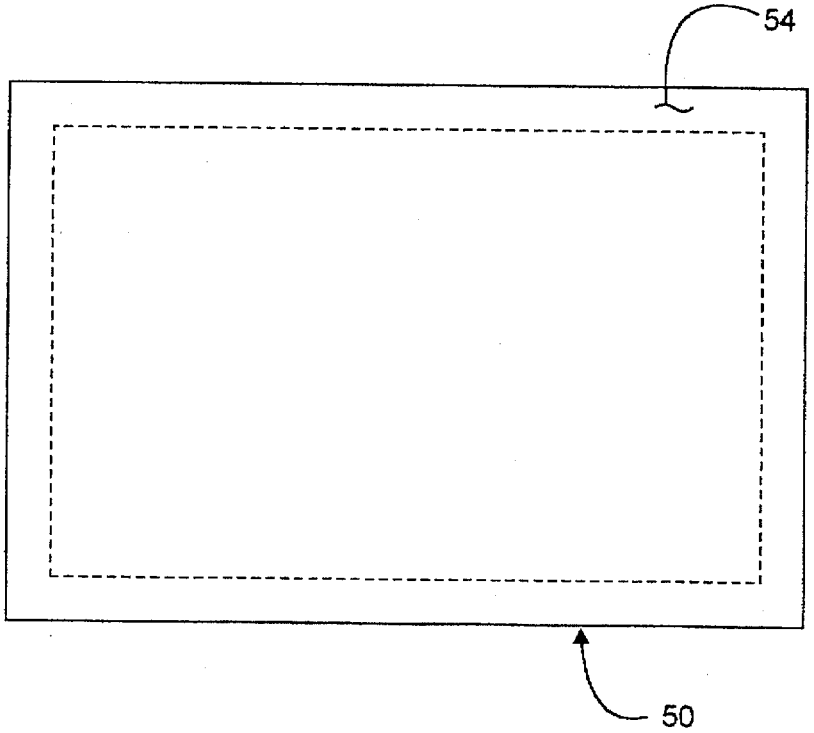
FIG. 7 schematically illustrates a plan view of the conforming filter shown in FIG. 6.

Another embodiment of the present invention is illustrated in FIG. 6. Here a conforming filter 50 is retained in position against curved faceplate 26 and substantially conforming to the curvature thereof. Filter 50 is located entirely within aperture 29 of bezel 28 and may not be retained in position by bezel 28. Referring to FIG. 6A, which shows detail of region 27 of FIG. 6, Filter 50 may be retained in position by adhesive strips 52 located at or close to edges of filter 50. Referring to FIG. 7 which shows a plan view of filter 50, adhesive strips 52 (not shown) are preferably located in perimeter region 54. Adhesive strips 52 may occupy all or part of perimeter region 54. Adhesive strips 52 are preferably made of a transparent adhesive material such as double stick adhesive tape available from 3M Corporation of St. Paul, Minn. The embodiment of FIG. 6 may be used, for example, when bezel 28 is difficult to remove from VDU assembly 20 without special tools or skills, or when there is insufficient clearance in VDU assembly 20 to allow a filter to be located behind bezel 28.

In yet another embodiment of the present invention a conforming filter may be attached to the front of a bezel which has a curved front surface. The filter may be attached to the bezel such that it generally conforms to the curvature of the front surface.

Figure 8:
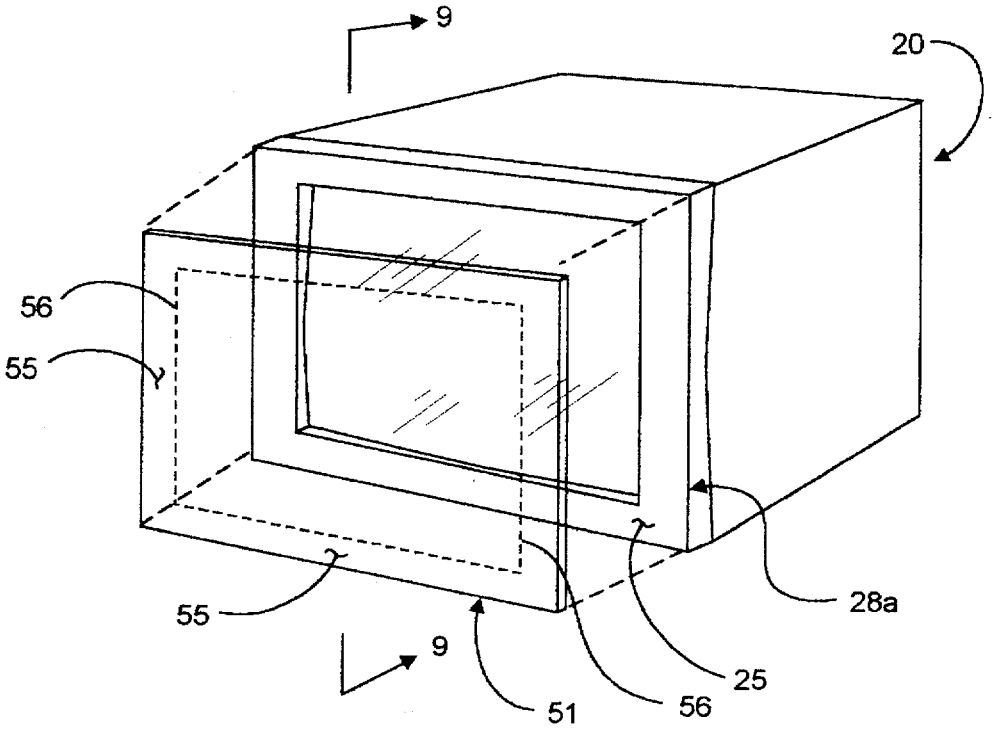
FIG. 8 schematically illustrates an exploded view of a VDU including a bezel having a curved front surface, and a conforming filter of the present invention designed for mounting on the curved front surface.
Figure 9:
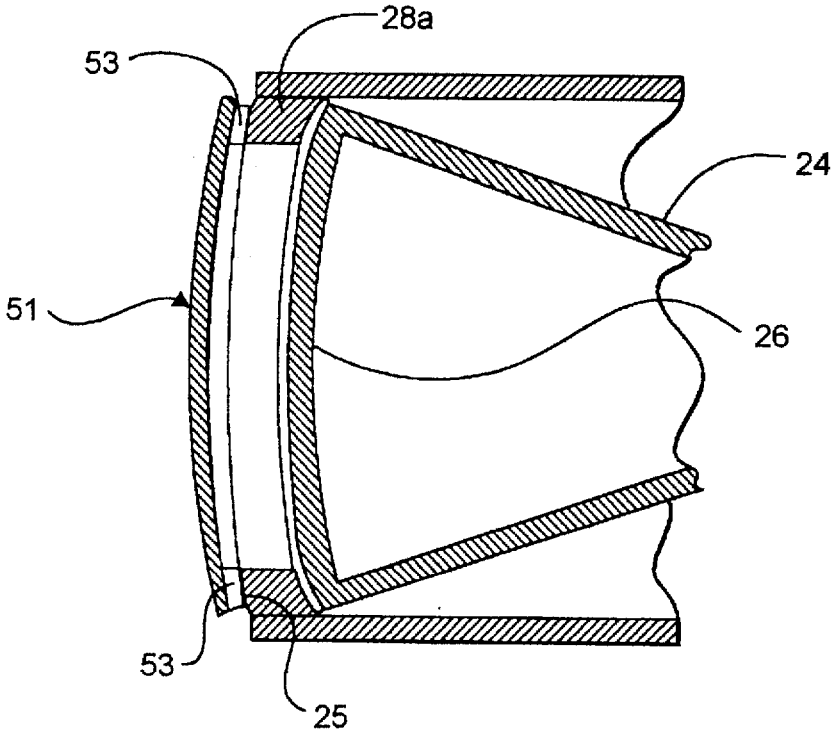
FIG. 9 schematically illustrates a cross section through the VDU taken in the direction 9—9 of FIG. 8 wherein the conforming filter is mounted on a bezel.

Referring now to FIGS. 8 and 9, conforming filter 51 may be attached to a bezel 28*a* having a curved front surface 25. A perimeter region 55 of filter 51 indicated by dotted line 56 substantially covers surface 25. When perimeter region 55 is pressed against surface 25, filter. 51 conforms generally to the surface curvature of surface 25. As shown in FIG. 9, filter 51 may be retained in position by adhesive strips 53 (not shown in FIG. 8). Preferably adhesive strips 53 are transparent so that their presence is not obtrusive. Preferably adhesive strips 53 are arranged to cover the entire surface 25 of bezel 28*a*.

Figure 10:
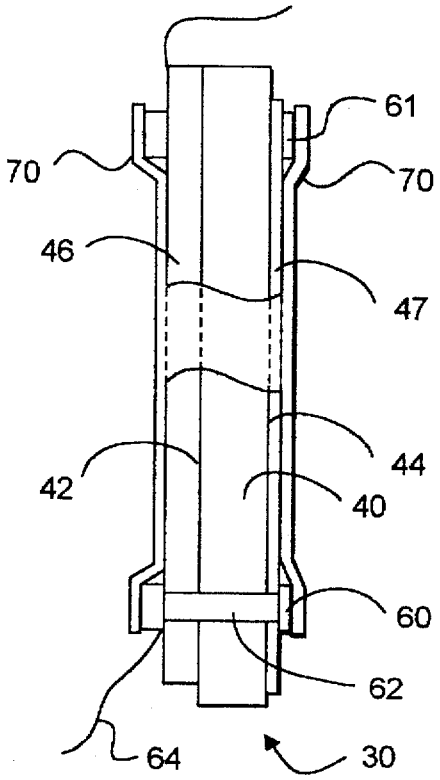
FIG. 10 schematically illustrates a cross section of the filter of FIG. 5 including removable protective cover sheets.

Thickness A is such that substrate 40 may be trimmed or cut to shape relatively easily with scissors. Thus it is not necessary to fabricate a filter to match every specific model and shape of VDU. Referring now to FIG. 10, a conforming filter according to the present invention may be protected prior to assembly by removable protective layers 70 applied over filter coatings 46 and 47. Layers 70 may be held in place by an adhesive which does not leave a residue on the filter coatings when removed. Protective layers 70 may be a sheet material, for example, vinyl strippable sheets available from DuPont Corporation of Wilmington, Del. Such material may remain in place during the above described trimming or cutting operations to prevent damage to filter surfaces.

Where conductive layers are incorporated in filter coatings it is usual to provide grounding a means, including a grounding connection, for connecting conductive layers to ground. Referring now to FIG. 3 as well as FIG. 10 a grounding connection 60 may be attached near a corner of filter 30, as shown. The grounding connection is preferably located between about 0.5 centimeter and 1.0 centimeter (cm) from edges 41 and 43 of substrate 40. The connection may comprise, for example, a rivet 62 extending through substrate 40 as shown in FIG. 5. Rivet 62 is used to hold a grounding wire 64 in electrical contact with filter coatings 46 and/or 47. Grounding wire 64 may be used to connect a one or more electrically conductive layers in filter coatings 46 and/or 47 to ground. When filter 30 is used to suppress electromagnetic radiation, it is preferable to use an additional grounding connection 61 located diagonally opposite grounding connection 60 as shown in FIG. 3.

The non-mesh conforming filter of the present invention comprises a transparent plastic substrate, preferably a polycarbonate material. The substrate is coated on at least one surface with a filter coating having at least anti-reflective properties. The filter coating may also include at least one electrically conductive layer and may also attenuate visible light. A filter coating may also be deposited on another surface of the substrate. The substrate is preferably rigid enough to have filter coatings applied when it is in the form of a flat sheet yet flexible enough that the filter may be caused to substantially conform to the curvature of a CRT faceplate by placing the filter against the faceplate and applying pressure around a perimeter region of the filter.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method for shielding a cathode ray tube having a curved faceplate comprising the following steps:

providing a substantially flat transparent plastic substrate having a thickness between about 0.8 mm and 1.2 mm, said plastic substrate being composed of a polycarbonate or acrylic material which when bent to conform to said curved faceplate will bend without fracturing and also when bent remains wrinkle free to preserve its optical properties;

coating said flat plastic substrate on at least one surface to provide a filter;

affixing said coated substrate to said faceplate causing it to bend to substantially conform to the surface of said curved faceplate.

2. The method of claim 1, wherein said plastic substrate and/or said filter coating attenuates visible light.

3. The method of claim 1, further including a second filter coating on a second surface, said second filter coating having at least anti-reflective properties.

4. The method of claim 1, wherein said filter coating includes at least one electrically conductive layer.

5. The method of claim 4 further including grounding means for connecting said at least one electrically conductive layer to ground.

* * * * *